US008511672B2

(12) United States Patent
Kubo

(10) Patent No.: US 8,511,672 B2
(45) Date of Patent: Aug. 20, 2013

(54) SHEET FEEDING APPARATUS AND IMAGE FORMING APPARATUS

(75) Inventor: Shinji Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/565,170

(22) Filed: Aug. 2, 2012

(65) Prior Publication Data

US 2013/0049288 A1 Feb. 28, 2013

(30) Foreign Application Priority Data

Aug. 22, 2011 (JP) ..... 2011-180629

(51) Int. Cl.
*B65H 3/06* (2006.01)

(52) U.S. Cl.
USPC ..... 271/119

(58) Field of Classification Search
USPC ..... 271/109, 119, 120, 121; 492/38, 492/48
See application file for complete search history.

(56) References Cited

U.S. PATENT DOCUMENTS

| | | | | |
|---|---|---|---|---|
| 5,091,754 | A | 2/1992 | Abe et al. | |
| 6,300,970 | B1 | 10/2001 | Hamada et al. | |
| 6,716,017 | B2 * | 4/2004 | Papadopoulas | 425/194 |
| 2003/0080493 | A1 * | 5/2003 | Miyamoto | 271/119 |
| 2008/0136087 | A1 * | 6/2008 | Terao et al. | 271/119 |
| 2010/0013144 | A1 * | 1/2010 | Seike et al. | 271/119 |
| 2011/0316223 | A1 | 12/2011 | Takiguchi et al. | |

FOREIGN PATENT DOCUMENTS

| | | | |
|---|---|---|---|
| EP | 0908796 | A1 | 4/1999 |
| EP | 0908796 | B1 | 5/2004 |
| JP | 04075931 | A * | 3/1992 |
| JP | 06092489 | A * | 4/1994 |
| JP | 06199432 | A * | 7/1994 |
| JP | 2002-104675 | A | 4/2002 |

* cited by examiner

*Primary Examiner* — Jeremy R Severson
(74) *Attorney, Agent, or Firm* — Fitzpatrick, Cella, Harper & Scinto

(57) ABSTRACT

A roller main body including a roller core and a roller holder that supports the roller main body. The roller main body includes a boss protruding from each of both side surfaces of an end portion of the roller core, and a rib formed on each of the both side surfaces of the roller core, the roller holder includes a groove portion that detachably and rotatably supports the boss, and a recess that fixes the roller main body by locking the rib of the roller main body that rotates about the boss, the groove portion includes a rotation sliding contact portion that rotatably slides the boss, and a guiding path portion that guides the boss to the rotation sliding contact portion, and the guiding path portion is formed to have a width smaller than a maximum diameter of the boss.

6 Claims, 10 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly, to a sheet feeding apparatus separating sheets one by one and feeding the sheets, and an image forming apparatus including the sheet feeding apparatus.

2. Description of the Related Art

Recently, in an image forming apparatus, a roller main body of a sheet feeding apparatus feeding a sheet is desired to have a configuration allowing a user and the like to easily replace the roller main body, and various types of the image forming apparatus including a replaceable roller main body are being provided (See U.S. Pat. No. 6,300,970 and Japanese Patent Laid-Open No. 2002-104675).

Here, a replaceable feeding roller of an image forming apparatus in the related art will be described with reference to FIGS. 10A to 10C. Referring to FIGS. 10A to 10C, a feeding roller in the related art includes a roller main body 100 in which a tubular rubber member 102 adheres to a circumference surface of a roller core 101 having a segment of a circle as a cross-sectional surface, and a roller holder 103 supporting the roller main body 100. The roller core 101 includes bosses 101*a* and 101*a*, ribs 101*b* and 101*b*, and ribs 101*c* and 101*c* formed on each of both side surfaces in an axial direction. On the other hand, the roller holder 103 includes recesses 103*a* and 103*a* that may lock the bosses 101*a* and 101*a*, holes 103*b* and 103*b* in which the ribs 101*b* and 101*b* snap-fits (fits), and recesses 103*c* and 103*c* locking the ribs 101*c* and 101*c*.

When the roller main body 100 is fitted in the roller holder 103 having the above-described configuration, the roller main body 100 is moved in a direction of an arrow S2 illustrated in FIG. 10C, and then the bosses 101*a* and 101*a* are locked in the recesses 103*a* and 103*a*. Then, the ribs 101*c* and 101*c* are locked in the recesses 103*a* and 103*a* by rotating the roller main body 100 on the boss 101*a* in a direction of an arrow R2 illustrated in FIG. 10B. Further, the ribs 101*b* and 101*b* are snap-fitted in the holes 103*b* and 103*b* provided in outwardly displaceable snap-fit portions 103*d* and 103*d*. Thus, the roller main body 100 is mounted in the roller holder 103.

On the other hand, when the roller main body 100 mounted in the roller holder 103 is detached, the snap-fit between the ribs 101*b* and 101*b* and the holes 103*b* and 103*b* is released by causing the snap-fit portions 103*d* and 103*d* of the roller holder 103 to fall outward. Then, after the roller main body 100 is rotated on the boss 101*a* in a direction of an arrow R1 illustrated in FIG. 10B, the bosses 101*a* and 101*a* are removed from the recesses 103*a* and 103*a* by moving the roller main body 100 in a direction of an arrow S1 illustrated in FIG. 10C. Thus, the roller main body 100 may be detached from the roller holder 103.

Incidentally, in the related art, when the roller main body 100 is rotated in the direction of the arrow R2 to attach the roller main body 100 to the roller holder 103, the roller main body 100 needs to be rotated while being pressed so as to prevent the boss 101*a* from deviating from the recesses 103*a* and 103*a*. In particular, when the roller main body 100 is rotatably held in a predetermined range, the roller holder 103 needs to be pressed with one hand, and the roller main body 100 needs to be mounted in the roller holder 103 with the other hand. As described above, workability has been poor when replacing a roller in a conventional roller configuration, which corresponds to an issue.

Accordingly, the invention is intended to provide a sheet feeding apparatus in which replacement of a feeding roller is simplified with a simple configuration, and an image forming apparatus including the sheet feeding apparatus.

SUMMARY OF THE INVENTION

According to the present invention, there is provided a sheet feeding apparatus including a feeding roller that presses a sheet corresponding to an uppermost surface of sheets stacked on a sheet stacking portion and discharges the sheet, wherein the feeding roller includes a roller main body including a roller core having a segment of a circle as a cross-sectional surface orthogonal to an axial direction, and an elastic member wound around a roller surface of the roller core, and a roller holder that supports the roller main body from both sides in the axial direction so that the elastic member of the roller main body protrudes to an outer circumstance. The roller main body includes a shaft portion protruding from each of both side surfaces of an end portion of the roller core, and a locking portion formed on each of the both side surfaces of the roller core. The roller holder includes a supporting portion that detachably and rotatably supports the shaft portion, and a locked portion that fixes the roller main body to the roller holder by locking the locking portion of the roller main body that rotates using the shaft portion mounted on the supporting portion as a rotation fulcrum. The supporting portion includes a rotation sliding contact portion that rotatably slides the shaft portion, and a guiding path portion that guides the shaft portion to the rotation sliding contact portion, and the guiding path portion is formed to have a width smaller than a maximum diameter of the shaft portion.

According to the invention, by attaching a roller main body to a roller holder in a state in which deviation is prevented, and then rotating a feeding roller to fix the feeding roller to the roller holder, it is possible to easily replace the roller main body without degrading the quality of the replacement of the roller main body.

Further features of the present invention will become apparent from the following description of exemplary embodiments with reference to the attached drawings.

DESCRIPTION OF THE EMBODIMENTS

Hereinafter, an image forming apparatus including a sheet feeding portion as a sheet feeding apparatus according to an embodiment of the invention will be described with reference to the drawings. The image forming apparatus according to an embodiment of the invention is an electrophotographic image forming apparatus including a sheet feeding portion that feeds sheets while separating the sheets one by one such as a copying machine, a printer, a facsimile, a multifunction peripheral (MFP) thereof, and the like. In the following embodiments, a laser beam printer 1 will be described later as an example of the electrophotographic image forming apparatus.

First Embodiment

Figure 1:
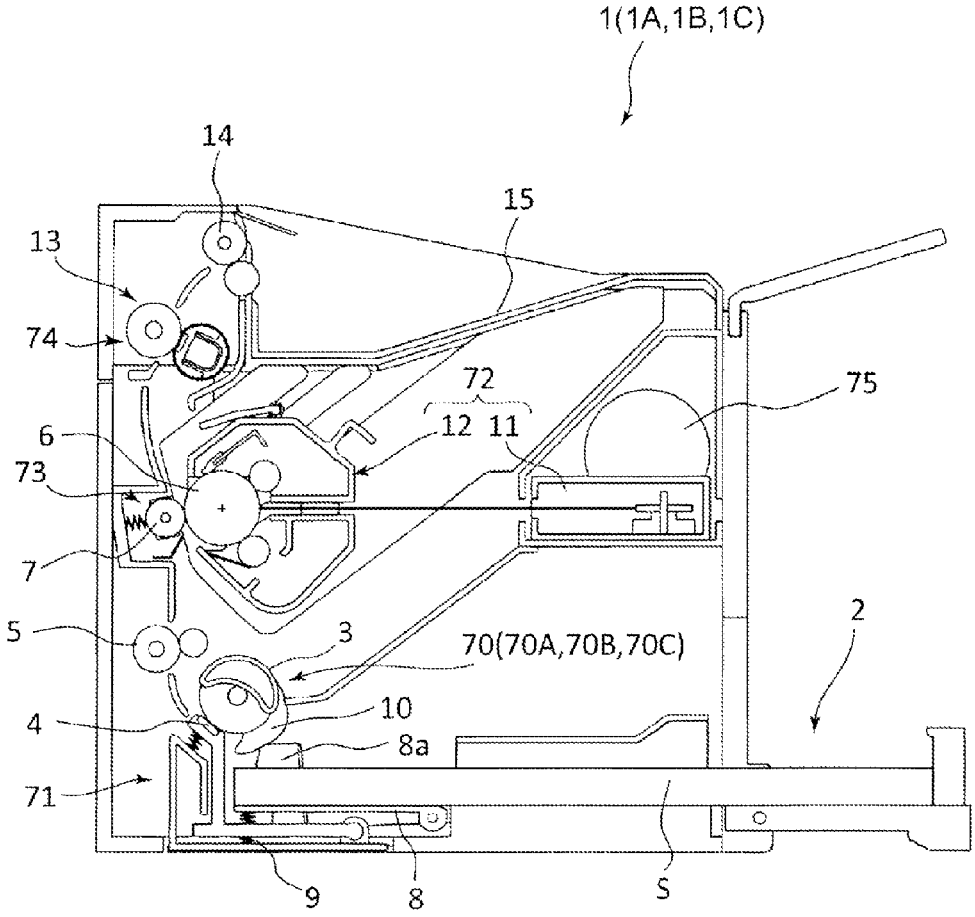
FIG. 1 is a cross-sectional view schematically illustrating an overall configuration of a laser beam printer according to an embodiment of the invention.
Figure 2:
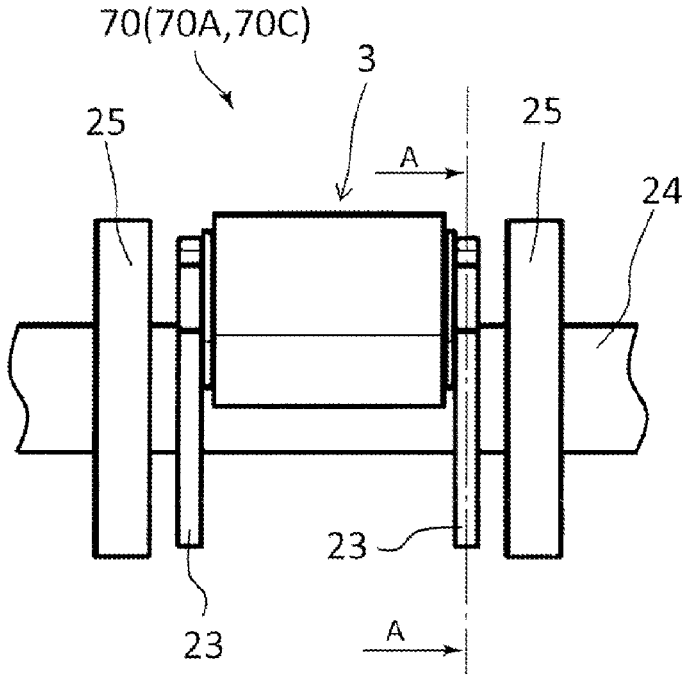
FIG. 2 is a top view illustrating a feeding roller according to a first embodiment.

A laser beam printer 1 according to a first embodiment of the invention will be described with reference to FIGS. 1 to 4C. First, an overall configuration of the laser beam printer 1 according to the first embodiment will be described with reference to FIGS. 1 and 2 along with an image forming process operation of the laser beam printer 1. FIG. 1 is a cross-sectional view schematically illustrating an overall configuration of the laser beam printer 1 according to the embodiment of the invention. FIG. 2 is a top view illustrating a feeding roller 70 according to the first embodiment.

As illustrated in FIG. 1, the laser beam printer 1 according to the first embodiment includes a sheet feeding portion 71 that feeds sheets S, an image forming portion 72 that forms an image, a transfer portion 73 that transfers the image, and a fixing portion 74 that fixes the image.

The sheet feeding portion 71 includes a sheet tray 2 as a sheet stacking portion that stacks the sheets S, a feeding roller 70 that feeds the sheets S, and a separation pad 4 that separates the sheets S one by one. As illustrated in FIG. 2, the feeding roller 70 includes a roller main body 3 that discharges sheets S out by pressing the sheets S, roller holders 23 and 23 that support the roller main body 3, a feeding shaft 24, and a feeding rolls 25 and 25 that convey the sheets S. The roller holders 23 and 23 are fixed on the feeding shaft 24, and the feeding rolls 25 and 25 are rotatably supported by the feeding shaft 24. The feeding shaft 24 is rotatably supported by a frame (not illustrated), and a cam 10 is provided on the same axis as the feeding shaft 24.

The cam 10 is in sliding contact with a cam follower 8*a* provided on an elevating plate 8 that lifts and lowers the sheet tray 2, and is configured to rotate in response to the feeding roller 70 (feeding shaft 24) rotating by a driving force transmitted from a drive motor 75. When the cam 10 rotates, the elevating plate 8 urged in an upward direction by the feeding spring 9 is lifted and thus, an uppermost surface of the sheets S on the sheet tray 2 is pressed by the roller main body 3 via a cam follower 8*a*, and the sheets S are discharged while being separated one by one by the separation pad 4. The sheets S discharged by the roller main body 3 are conveyed, by a pair of conveying rollers 5, to the transfer portion 73 configured by a nip between a photosensitive drum 6 and a transfer roller 7 described later. Here, the feeding roller 70 will be described in detail.

An image starts to be formed by the image forming portion 72 concurrently with the feeding of the sheets S. The image forming portion 72 includes a laser scanner 11 and a process cartridge 12, the laser scanner 11 draws an electrostatic latent image on the photosensitive drum 6 inside the process cartridge 12, and the electrostatic latent image is visualized through a toner development using a developing device inside the process cartridge 12. The visualized toner image is transferred as a non-fixed image on the sheets S conveyed to the transfer portion 73 by the pair of conveying rollers 5. The sheet S on which the non-fixed image is transferred is sent to a fixing device 13 of the fixing portion 74 to fix the non-fixed image, and the non-fixed image is thermally fixed on the sheets S. The sheets S on which the thermal fixation of the non-fixed image is completed are sent to a pair of discharge rollers 14, and discharged to a discharge tray 15. Thus, the image forming process using the laser beam printer 1 is completed.

Figure 3:
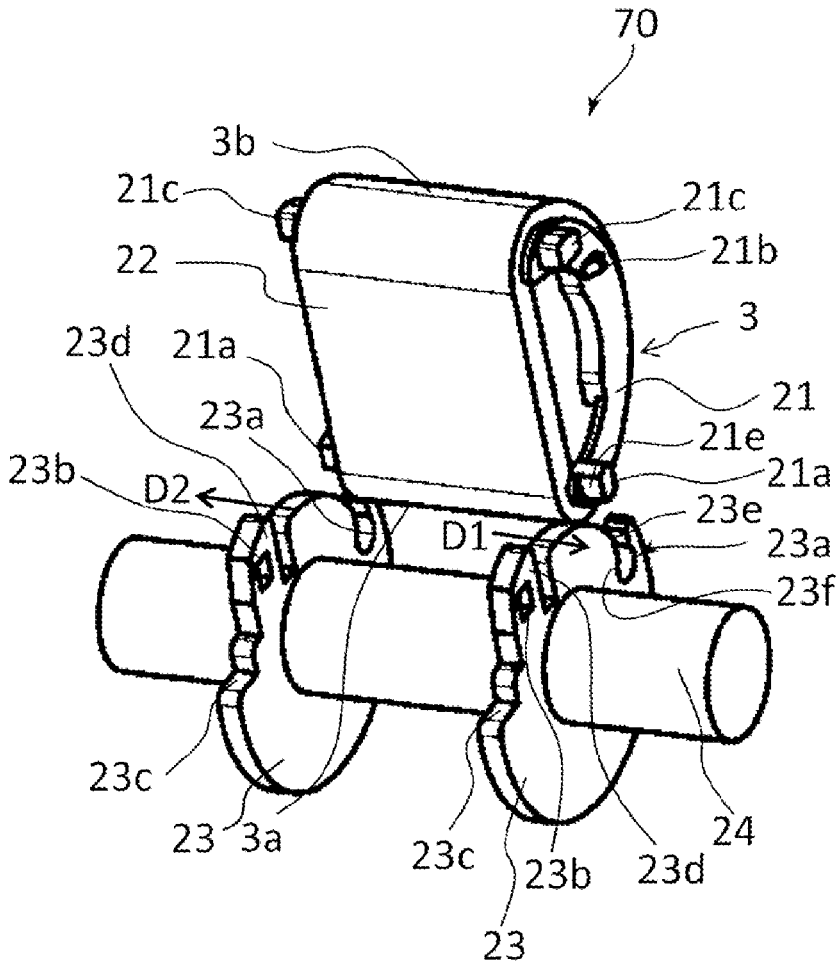
FIG. 3 is a perspective view illustrating a state in which a roller main body is to be attached to a roller holder.
Figure 4A:
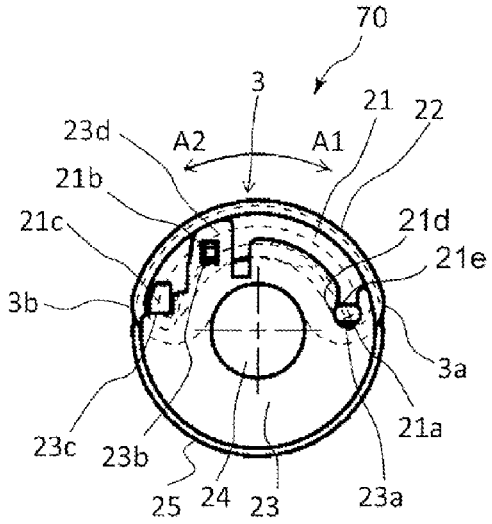
FIG. 4A is a cross-sectional view of a feeding roller 70 when viewed in the direction of an arrow A-A illustrated in FIG. 2 according to the first embodiment.
Figure 4B:
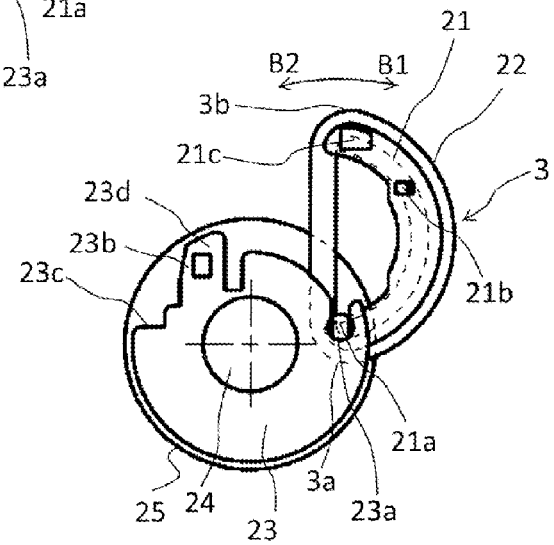
FIG. 4B is a cross-sectional view illustrating a state in which a roller main body illustrated in FIG. 4A is being attached to a roller holder.
Figure 4C:
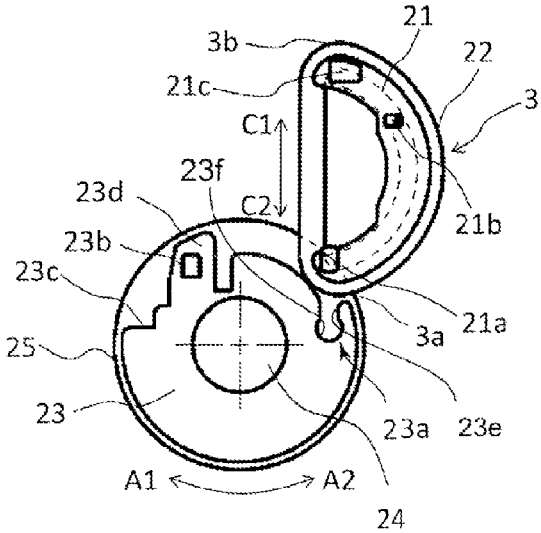
FIG. 4C is a cross-sectional view illustrating a state in which a roller main body illustrated in FIG. 4A is to be attached to a roller holder.

Subsequently, the feeding roller 70 according to the first embodiment will be described with reference to FIGS. 3 to 4C in additional to FIG. 2. First, a configuration of the feeding roller 70 will be described with reference to FIGS. 2 to 4A. FIG. 3 is a perspective view illustrating a state in which the roller main body 3 is to be attached to the roller holder 23. FIG. 4A is a cross-sectional view of the feeding roller 70 when viewed in the direction of an arrow A-A illustrated in FIG. 2 according to the first embodiment. Here, the feeding rolls 25 and 25 supported by the feeding shaft 24 are not illustrated in FIG. 3.

As illustrated in FIGS. 2 and 3, the feeding roller 70 includes the roller main body 3 having a substantially semilunar shape in which a cross-sectional surface perpendicular to an axial direction is a segment of a circle, the roller holders 23 and 23 that support the roller main body 3, a feeding shaft 24, and the feeding rolls 25 and 25. The feeding roller 70 includes the roller holders 23 and 23 that are disposed at a substantially central portion of the rotatably supported feeding shaft 24, and support the roller main body 3 at both sides on the axial direction, and the feeding rolls 25 and 25 that are rotatably disposed at both sides of the roller holders 23 and 23. Here, the feeding roller 70 may not employ the feeding rolls 25 and 25.

The roller main body 3 has a substantially semilunar shape including an arc portion and a circle-segment portion as a whole, and as illustrated in FIG. 4A, is attached to the roller holders 23 and 23 so that the arc portion protrudes from an outer circumference of the roller holders 23 and 23. The roller main body 3 rotates in a direction of an arrow A1 illustrated in FIG. 4A by the roller holders 23 and 23 rotating in the direction of the arrow A1, and discharges the sheets S from the sheet tray 2 by pressing the sheets S with the arc portion.

The roller main body 3 includes a roller core 21 in which a cross-sectional surface perpendicular to an axial direction is an arc shape, and a rubber member 22 as an elastic member having an endless shape that is wound around a roller surface (circumference surface) of the roller core 21. The roller core 21 includes bosses 21*a* and 21*a* as a shaft portion, ribs 21*b* and 21*b* as a locking portion, and ribs 21*c* and 21*c* as a locking portion on each of the both side surfaces perpendicular to the roller surface. The bosses 21*a* and 21*a* protrude to an end portion (hereinafter, referred to as a leading end portion) that comes into contact with the sheets S when the roller main body 3 initially rotates in the direction of the arrow A1. According to the first embodiment, the bosses 21*a* and 21*a* include arc portions 21*d* and 21*d*, and linear portions 21*e* and 21*e* as a chamfered portion chamfered so that a diameter in a direction perpendicular to an axial direction is smaller than a width of a guiding path portion described later, and are formed in a cylindrical shape having a substantially oval shape as a cross-sectional surface.

The ribs 21*c* and 21*c* are provided at another end portion (hereinafter, referred to as a feeding rear end portion) that comes in contact with the sheets S when the roller main body 3 initially rotates in the direction of the arrow A1. The ribs 21*c* and 21*c* are formed so that the roller main body 3 rotated in a direction of an arrow B2 illustrated in FIG. 4B described later may be locked in the roller holder 23 after the roller main body 3 is rotatably supported (temporary joint) on the bosses 21*a* and 21*a*. According to the first embodiment, the ribs 21*c* and 21*c* are substantially formed in a horn shape, and protrude from both side surfaces of the roller core 21. The ribs 21*b* and 21*b* are provided between the bosses 21*a* and 21*a* and the ribs 21*c* and 21*c*, and are formed to protrude from the both side surfaces of the roller core 21.

The rubber member 22 is wound around the roller core 21 so as to cover the roller surface of the roller core 21, and a portion positioned at the arc portion of the roller main body 3 comes in contact with the sheets S to discharge the sheets S. Further, when the roller main body 3 is mounted on the roller holders 23 and 23, the rubber member 22 positioned at the circle-segment portion is elastically deformed by coming into contact with the feeding shaft 24, thereby urging the roller main body 3 in a direction of an arrow B1 of FIG. 4B using the bosses 21*a* and 21*a* as a center of rotation.

As illustrated in FIG. 3, the roller holders 23 and 23 includes groove portions 23*a* and 23*a* as a supporting portion, recesses 23*c* and 23*c* as a locked portion, and snap-fit portions 23*d* and 23*d* as a locked portion.

The groove portions 23*a* and 23*a* are formed so as to detachably and rotatably support the bosses 21*a* and 21*a*. The groove portions 23*a* and 23*a* include rotation sliding contact portions 23*f* and 23*f* that rotatably slide the bosses 21*a* and 21*a*, and guiding path portions 23*e* and 23*e* that may guide the bosses 21*a* and 21*a* to the rotation sliding contact portions 23*f* and 23*f*. The rotation sliding contact portions 23*f* and 23*f* are formed in an arc shape, and formed to have a diameter equal to or greater than a diameter (maximum diameter) of the arc portions 21*d* and 21*d* of the bosses 21*a* and 21*a*. The guiding path portions 23*e* and 23*e* are formed as a linear groove having a width smaller than the diameter of the arc portions 21*d* and 21*d*, and formed to be equal to or greater than a width (length in a radial direction) between the linear portions 21*e* of the bosses 21*a* and 21*a*.

The recesses 23*c* and 23*c* are formed to have a recess shape that may lock the ribs 21*c* and 21*c*. The snap-fit portion 23*d* is formed to be elastically deformable in a direction of arrows D1 and D2 illustrated in FIG. 3, and includes rectangle holes 23*b* and 23*b*, formed at a substantially central portion, that may lock the ribs 21*b* and 21*b*.

Subsequently, a method of attaching and detaching the roller main body 3 to and from the roller holder 23 according to the first embodiment will be described with reference to FIGS. 4B and 4C in addition to FIG. 4A. FIG. 4B is a cross-sectional view illustrating a state in which the roller main body 3 illustrated in FIG. 4A is being attached to the roller holder 23. FIG. 4C is a cross-sectional view illustrating a state in which the roller main body 3 illustrated in FIG. 4A is to be attached to the roller holder 23.

First, a case of attaching the roller main body 3 to the roller holder 23 will be described. When the roller main body 3 is attached to the roller holder 23, positioning is first performed such that the linear portions 21*e* and 21*e* of the bosses 21*a* and 21*a* of the roller core 21 are substantially parallel to the guiding path portions 23*e* and 23*e* of the groove portions 23*a* and 23*a* as illustrated in FIG. 4C. After the positioning is performed, the roller main body 3 is moved in a direction of an arrow C2 illustrated in FIG. 4C. In this instance, since the linear portions 21*e* and 21*e* of the bosses 21*a* and 21*a* are formed to have a width equal to or smaller than the width of the guiding path portions 23*e* and 23*e* of the groove portions 23*a* and 23*a*, the positioning enables the bosses 21*a* and 21*a* to move (mount) in the direction of the arrow C2.

As illustrated in FIG. 4B, the roller main body 3 is rotated in the direction of the arrow B2 using the bosses 21*a* and 21*a* as rotation fulcrums after mounting the bosses 21*a* and 21*a* by moving the bosses 21*a* and 21*a* up to the rotation sliding contact portions 23*f* and 23*f* inside of the groove portions 23*a* and 23*a*. In this instance, since a diameter of the rotation sliding contact portions 23*f* and 23*f* of the groove portions 23*a* and 23*a* is formed to be equal to or greater than a diameter of the arc portions 21*d* and 21*d* of the bosses 21*a* and 21*a*, the roller main body 3 may rotate in the direction of the arrow B2 using the bosses 21*a* and 21*a* as a rotation fulcrums. Further, the bosses 21*a* and 21*a* do not deviate from the groove portions 23*a* and 23*a* (rotation sliding contact portions 23*f* and 23*f*) when the roller main body 3 is rotated, and the roller main body 3 is temporarily joined to the roller holder 23.

When the roller main body 3 is further rotated in the direction of the arrow B2, the snap-fit portions 23*d* and 23*d* are respectively pushed out in the directions of the arrows D1 and D2 illustrated in FIG. 3 by the ribs 21*b* and 21*b*, and the ribs 21*b* and 21*b* engage with a pair of the rectangle holes 23*b* and 23*b*. Then, a pair of the ribs 21*c* and 21*c* is locked in a pair of the recesses 23*c* and 23*c* and thus, the snap-fit portions 23*d* and 23*d* return to an initial position. Accordingly, the roller main body 3 is fixed to the roller holders 23.

As described above, locating in a vertical direction during an attachment of the roller main body 3 to the roller holder 23 is performed by fitting the bosses 21*a* and 21*a* in the groove portions 23*a* and 23*a*, engaging the ribs 21*b* and 21*b* with the rectangle holes 23*b* and 23*b*, and locking the ribs 21*c* and 21*c* in the recesses 23*c* and 23*c*. Further, locating in a horizontal direction during an attachment of the roller main body 3 to the roller holder 23 is performed by fitting the bosses 21*a* and 21*a* in the groove portions 23*a* and 23*a*, and locking the ribs 21*c* and 21*c* in the recesses 23*c* and 23*c*.

Subsequently, a case of detaching the roller main body 3 from the roller holder 23 will be described. When the roller main body 3 is detached from the roller holder 23, the snap-fit portions 23*d* and 23*d* are first respectively pushed out in the directions of the arrows D1 and D2 illustrated in FIG. 3 to release the ribs 21*b* and 21*b* locked in the rectangle holes 23*b* and 23*b*. In response to releasing the ribs 21*b* and 21*b* locked in the rectangle holes 23*b* and 23*b*, the roller main body 3 is rotated in the direction of the arrow B1 using the bosses 21*a* and 21*a* as rotation fulcrums. When the linear portions 21*e* and 21*e* of the bosses 21*a* and 21*a* of the roller core 21 is substantially parallel to the guiding path portions 23*e* and 23*e* of the groove portions 23*a* and 23*a* by rotating the roller main body 3 in the direction of the arrow B1, the roller main body 3 is moved in the direction of the arrow C1. Thus, the roller main body 3 mounted in the roller holder 23 may be detached from the roller holder 23.

As described above, the feeding roller 70 of the laser beam printer 1 according to the first embodiment employs a configuration in which the bosses 21*a* and 21*a* are enabled to be temporarily joined to the groove portions 23*a* and 23*a* so as to be rotatable while the bosses 21*a* and 21*a* are prevented from detaching. In particular, by rotating the roller main body 3 after inserting the bosses 21*a* and 21*a* into the rotation sliding contact portions 23*f* and 23*f* through the guiding path portions 23*e* and 23*e*, the roller main body 3 is prevented from deviating from the groove portions 23*a* and 23*a*. Thus, when the roller main body 3 is mounted, the roller main body 3 may be temporarily joined to the roller holder 23 concurrently with the locating of the roller main body 3. As such, for example, since the bosses 21*a* and 21*a* do not deviate from the groove portions 23*a* and 23*a* when the roller main body 3 is rotated in the direction of the arrow B1 or the arrow B2, the roller main body 3 may not be pressed while being rotated. As a result, the roller main body 3 is prevented from deviating during an operation and thus, the roller main body 3 may be easily mounted in the roller holder 23. Accordingly, replacement of the roller main body 3 is simplified.

Second Embodiment

Subsequently, a laser beam printer 1A according to a second embodiment of the invention will be described with reference to FIGS. 5A to 6 along with FIGS. 1 and 2. In the second embodiment, a groove portion formed in a roller holder is different from a groove portion according to the first embodiment. Thus, in the second embodiment, the portion different from the first embodiment, that is, a groove portion of a roller holder will be mainly described, and a configuration similar to the first embodiment will not be described.

Figure 5A:
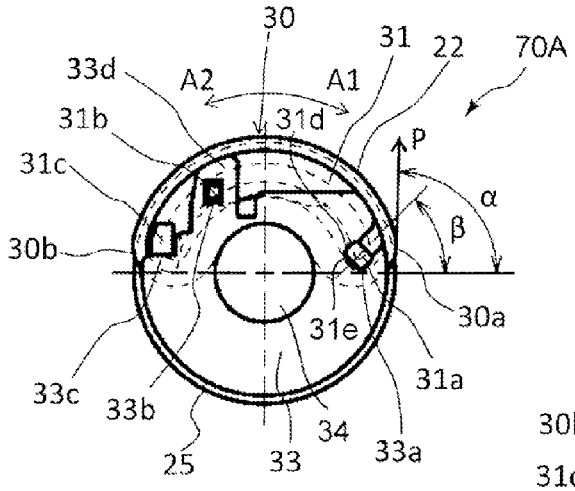
FIG. 5A is a cross-sectional view of a feeding roller when viewed in the direction of an arrow A-A illustrated in FIG. 2 according to a second embodiment.
Figure 5B:
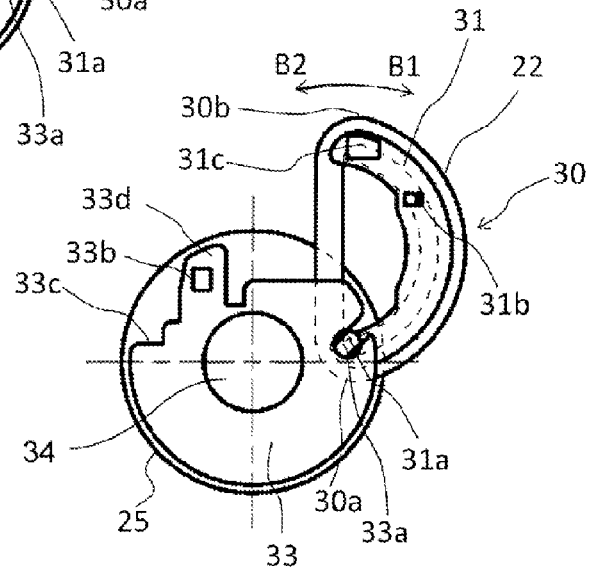
FIG. 5B is a cross-sectional view illustrating a state in which a roller main body illustrated in FIG. 5A is being attached to a roller holder.
Figure 5C:
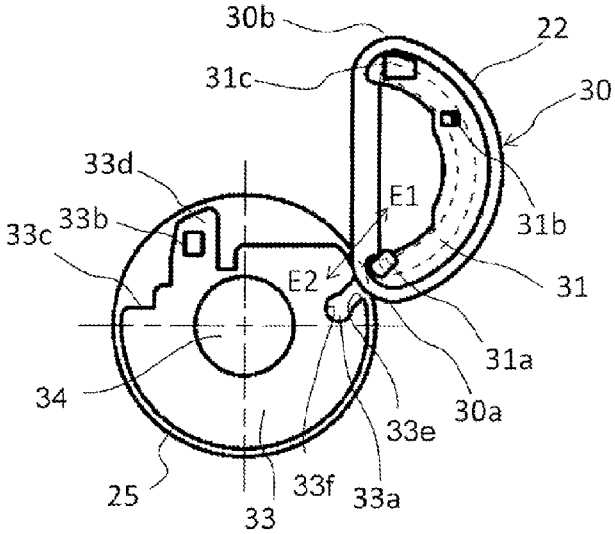
FIG. 5C is a cross-sectional view illustrating a state in which a roller main body illustrated in FIG. 5A is to be attached to a roller holder.

FIG. 5A is a cross-sectional view when viewed in a direction of an arrow A-A of FIG. 2 according to the second embodiment. FIG. 5B is a cross-sectional view illustrating a state in which a roller main body 3 illustrated in FIG. 5A is being attached to roller holders 23A and 23A. FIG. 5C is a cross-sectional view illustrating a state in which the roller main body 3 illustrated in FIG. 5A is to be attached to the roller holders 23A and 23A. FIG. 6 is a partially enlarged cross-sectional view of FIG. 5A.

Referring to FIG. 5A, a feeding roller 70A includes a roller main body 30, roller holders 33 and 33, feeding rolls 25 and 25, and a feeding shaft 34. The roller holders 33 and 33 include groove portions 33*a* and 33*a*, recesses 33*c* and 33*c*, and snap-fit portions 33*d* and 33*d*. The groove portions 33*a* and 33*a* include rotation sliding contact portions 33*f* and 33*f* that rotatably support bosses 31*a* and 31*a*, and guiding path portions 33*e* and 33*e* that guide the bosses 31*a* and 31*a* to the rotation sliding contact portions 33*f* and 33*f*. The rotation sliding contact portions 33*f* and 33*f* are formed in an arc shape, and formed to have a diameter equal to or greater than a diameter (maximum diameter) of arc portions 31*d* and 31*d* of the bosses 31*a* and 31*a*. The guiding path portions 33*e* and 33*e* are formed as a linear groove having a width smaller than the diameter of the arc portions 31*d* and 31*d*, and formed to be equal to or greater than a width (length in a radial direction) between the linear portions 31*e* of the bosses 31*a* and 31*a*.

Here, when a feeding is initiated, a reactive force P due to a contact with sheets S is applied to a leading end portion 30*a* of the roller main body 30 in a direction $\alpha$ illustrated in FIG. 5A. In particular, as illustrated in FIG. 6, the reactive force P is applied to a feeding initiation point 22*a* of a rubber member 22 corresponding to a point with which the sheets S initially come into contact when the feeding is initiated. In this instance, the reactive force P applied to the leading end portion 30*a* of the roller main body 30 is applied by the feeding roller 70A rotating, and the roller main body 30 coming into contact with the sheets S. Here, a state in which the roller main body 30 does not rotate is used for description based only on a direction in which the reactive force P is applied. Further, an angle $\alpha$ at which the reactive force P is applied is set to various angles based on a disposition angle of the roller main body 30, or a position of the feeding initiation point 22*a* of the rubber member 22.

Figure 6:
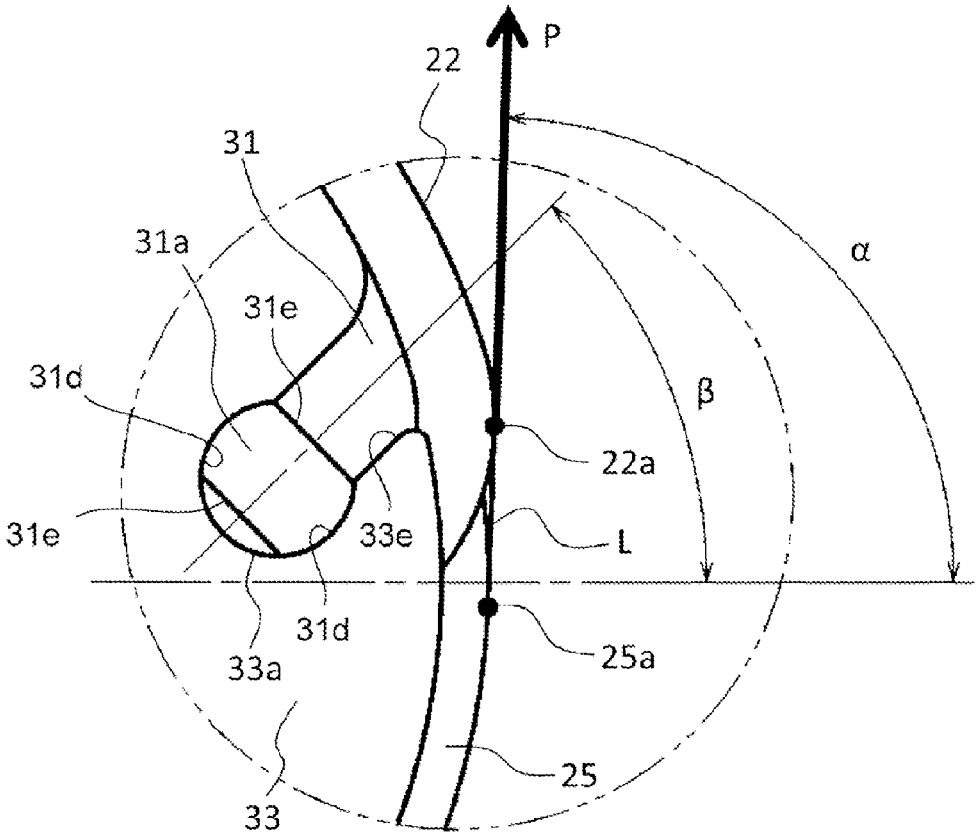
FIG. 6 is a partially enlarged cross-sectional view of FIG. 5A.

First, as illustrated in FIG. 6, a straight line (tangent line to the rubber member 22 and the feeding roll 25) passing through each of the feeding initiation point 22*a* and a contact point 25*a* of the feeding roll 25 is defined as a tangent line L, and an angle formed by the tangent line L and a horizontal axis. Since the reactive force P is applied at the angle $\alpha$, the roller main body 30 is to be separated from the roller holder 33 at the angle $\alpha$.

Here, in the first embodiment, a guiding direction of the guiding path portions 23*e* and 23*e* corresponding to an opening direction of the groove portion 23*a* provided in the roller holder 23 is formed to be substantially parallel to a vertical direction orthogonal to a horizontal axis illustrated in FIG. 5A. On the other hand, in the second embodiment, a guiding direction of the guiding path portions 33*e* and 33*e* of the groove portion 23*a* is inclined with respect to the horizontal axis illustrated in FIG. 6 toward a feeding rear end portion 30*b* by an angle $\beta$. In order to prevent the bosses 31*a* and 31*a* from being separated from the groove portions 33*a* and 33*a* due to the reactive force P applied to the roller main body 30, the angle $\beta$ needs to be set to be less than the angle $\alpha$ ($\beta<\alpha$).

In the second embodiment, the angle $\alpha$ is set to about 88 degrees with respect to the horizontal axis illustrated in FIG. 6, and the angle $\beta$ is set to about 45 degrees with respect to the horizontal axis illustrated in FIG. 6. Further, the bosses 31*a* and 31*a* of the roller core 31 are provided so that the guiding path portions 33*e* and 33*e* and the linear portions 31*e* and 31*e* are substantially parallel to each other when being guided to the guiding path portions 33*e* and 33*e* of the groove portions 33*a* and 33*a*.

In this instance, a method of attaching and detaching the roller main body 30 to and from the roller holder 33 according to the second embodiment is similar to the first embodiment, and description thereof will not be made.

As described above, in the feeding roller 70A of the laser beam printer 1A according to the second embodiment, a guiding direction of the guiding path portions 33*e* and 33*e* of the roller holder 33 is formed to be inclined by a predetermined angle ($\alpha-\beta$) with respect to the direction $\alpha$ in which the reactive force P from the sheets S is applied. Thus, reinforcement and the like may not be performed for the reactive force P from the sheets S due to a contact with the sheets S, and the roller main body 3 may be prevented from easily deviating from roller holder 33.

Third Embodiment

Subsequently, a laser beam printer 1B according to a third embodiment of the invention will be described with reference to FIGS. 7A to 8C along with FIG. 1. The third embodiment is different from the first embodiment in that a predetermined idling section is provided between a roller holder and a feeding shaft. Thus, in the third embodiment, the portion different from the first embodiment, that is, the predetermined idling section provided between the roller holder and the feeding shaft will be mainly described, and a configuration similar to the first embodiment will not be described.

Figure 7A:
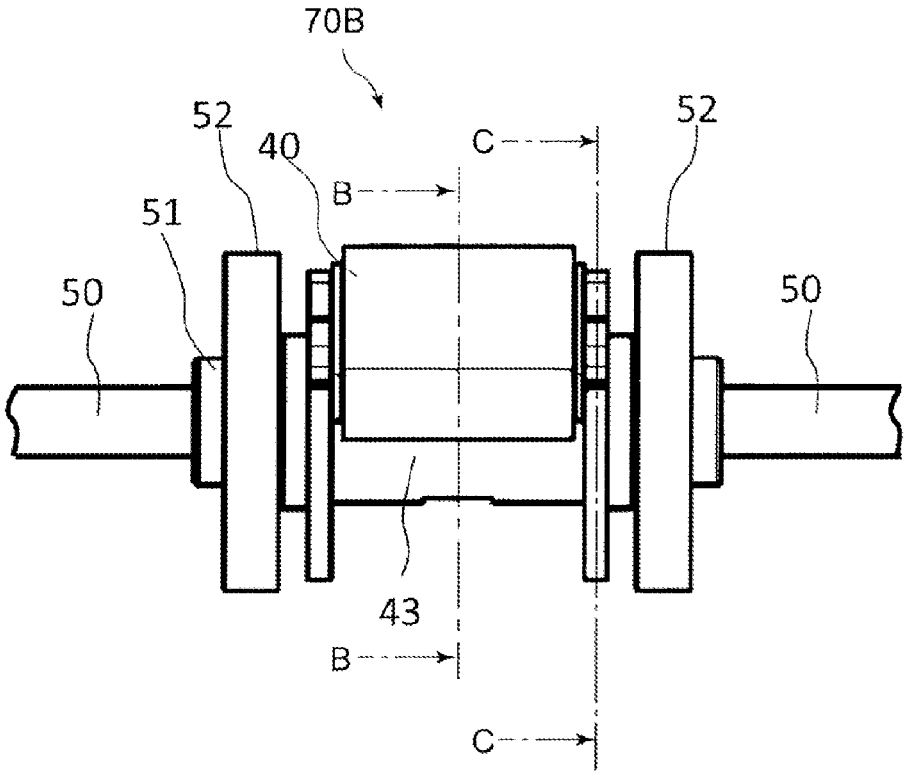
FIG. 7A is a top view illustrating a feeding roller according to a third embodiment.
Figure 7B:
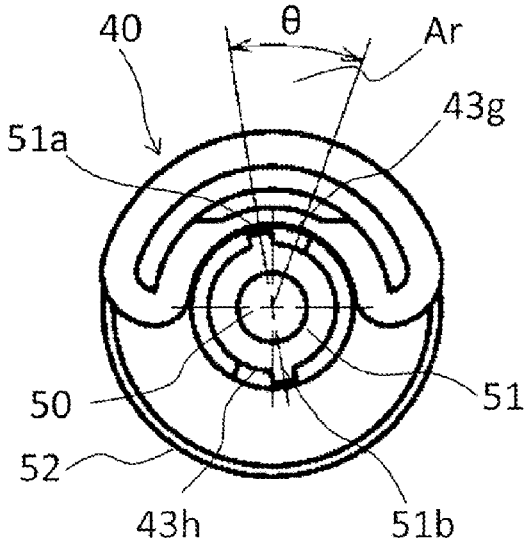
FIG. 7B is a cross-sectional view when viewed in the direction of an arrow B-B of FIG. 7A.
Figure 8A:
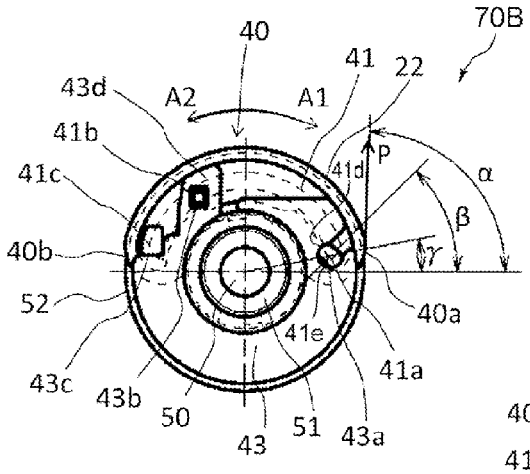
FIG. 8A is a cross-sectional view of a feeding roller when viewed in the direction of an arrow C-C illustrated in FIG. 7A.
Figure 8B:
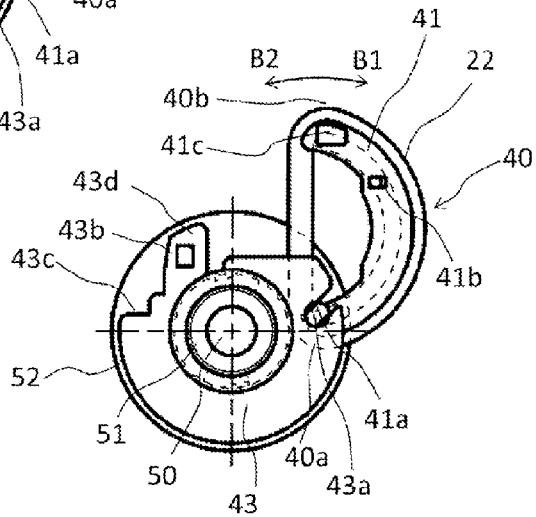
FIG. 8B is a cross-sectional view illustrating a state in which a roller main body illustrated in FIG. 8A is being attached to a roller holder.
Figure 8C:
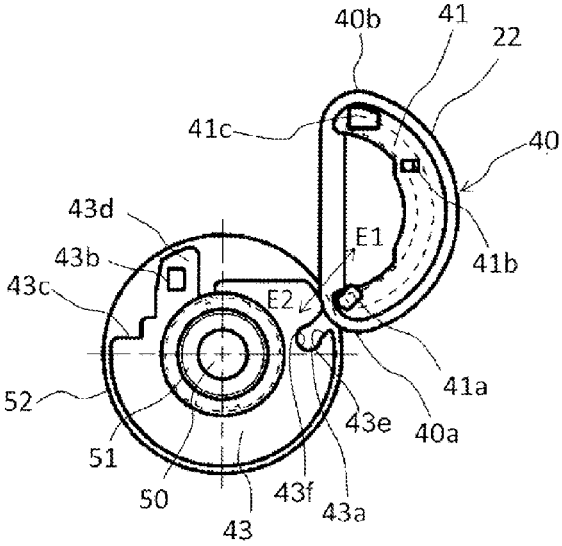
FIG. 8C is a cross-sectional view illustrating a state in which a roller main body illustrated in FIG. 8A is to be attached to a roller holder.

FIG. 7A is a top view illustrating a feeding roller 70B according to the third embodiment. FIG. 7B is a cross-sectional view when it is viewed in a direction of an arrow B-B of FIG. 7A. FIG. 8A is a cross-sectional view when it is viewed in a direction of an arrow C-C of FIG. 7A. FIG. 8B is a cross-sectional view illustrating a state in which a roller main body 40 illustrated in FIG. 8A is being attached to a roller holder 43. FIG. 8C is a cross-sectional view illustrating a state in which the roller main body 40 illustrated in FIG. 8A is to be attached to the roller holder 43.

As illustrated in FIG. 7A, the feeding roller 70B includes a roller main body 40, the roller holder 43, feeding rolls 52 and 52, a feeding shaft 50, and serration members 51 and 51. The roller holder 43 includes groove portions 43*a* and 43*a*, recesses 43*c* and 43*c*, and snap-fit portions 43*d* and 43*d*. The groove portions 43*a* and 43*a* include rotation sliding contact portions 43*f* and 43*f* that rotatably support the bosses 41*a* and 41*a*, and guiding path portions 43*e* and 43*e* that guide the bosses 41*a* and 41*a* to rotation sliding contact portions 43*f* and 43*f*. As illustrated in FIG. 7B, the serration members 51 and 51 are formed in a cylindrical shape fitted and fixed on the feeding shaft 50, and include projections 51*a* and 51*b* extending in an axial direction provided on an outer circumference portion. The roller main body 40 has a similar configuration to the first and second embodiments, and is supported on the roller holder 43 from both sides, and the roller holder 43 is supported on the feeding shaft 50.

Here, the roller holder 43 includes recesses 43*g* and 43*h* for forming an idling section Ar of an angle θ in a rotating direction, and the recesses 43*g* and 43*h* are formed to correspond to (control an operation of) the projections 51*a* and 51*b* of the serration members 51 and 51. That is, the roller holder 43 is rotatably formed in the idling section Ar formed by the recesses 43*g* and 43*h* and the projections 51*a* and 51*b*.

As illustrated in FIG. 8A, a guiding direction of the guiding path portions 43*e* and 43*e* of the groove portions 43*a* and 43*a* provided in the roller holder 43 is inclined at an angle β toward a feeding rear end portion 40*b* with respect to a horizontal axis. On the other hand, linear portions 41*e* and 41*e* of the bosses 41*a* and 41*a* of the roller main body 40 is substantially orthogonal to the guiding direction of the guiding path portions 43*e* and 43*e*. An angle β is set to be equal to or greater than an angle γ formed by the horizontal axis and a straight line connecting a center of the bosses 41*a* and 41*a* and a center of the roller holders 43 and 43.

As illustrated in FIG. 8C, since a guiding direction E2 in which the bosses 41*a* and 41*a* are inserted into the groove portions 43*a* and 43*a* is parallel to a slope of the angle β, a force is applied to the roller holders 43 and 43 in a direction of an arrow A1. Thus, the recesses 43*g* and 43*h* of the roller holder 43 and the projections 51*a* and 51*a* of the serration member 51 are maintained in a collided state. Thus, a rotation of the roller holder 43 is controlled between the roller holder 43 and the feeding shaft 50. As a result, since the roller holder 43 does not rotate when the roller main body 40 is attached to the roller holder 43, replacement of the roller main body 40 may be simplified.

On the other hand, in a case in which the angle β is set to be less than the angle γ, when the bosses 41*a* and 41*a* are inserted into the groove portions 43*a* and 43*a*, the roller holder 43 rotates in a direction of an arrow A2 in the idling section Ar. Thus, the bosses 41*a* and 41*a* are difficult to be inserted in the groove portions 43*a* and 43*a*, and the replacement of the roller main body 40 may be complicated.

Considering the above description, the angle β needs to be set to satisfy an inequality $\beta \geqq \gamma$. Further, as in the second embodiment, considering a reactive force P applied to the roller main body 40, the angle β needs to be set to satisfy an inequality $\gamma \leqq \beta < \alpha$. In this instance, in order to prevent the groove portions 43*a* and 43*a* from deforming, reinforcement of the roller holder 43 may be enhanced. However, since an extra cost and space for the reinforcement is needed, it is preferable to set the angle β based on the consideration.

By setting the angle β to satisfy the inequality $\gamma \leqq \beta < \alpha$, the roller holder 43 is prevented from rotating in the idling section Ar, the groove portions 43*a* and 43*a* are prevented from being deformed by the reactive force P applied to the roller main body 40 from the sheets S, and the roller main body 40 is prevented from wobbling and deviating.

Fourth Embodiment

Subsequently, a laser beam printer 1C according to a fourth embodiment will be described with reference to FIGS. 9A and 9B. In the fourth embodiment, a groove portion formed in a roller holder and a shaft portion of a roller main body is different from the first embodiment. Thus, in the fourth embodiment, the portion different from the first embodiment, that is, a groove portion of a roller holder and a shaft portion of a roller main body will be mainly described, and a configuration similar to the first embodiment will not be described.

Figure 9A:
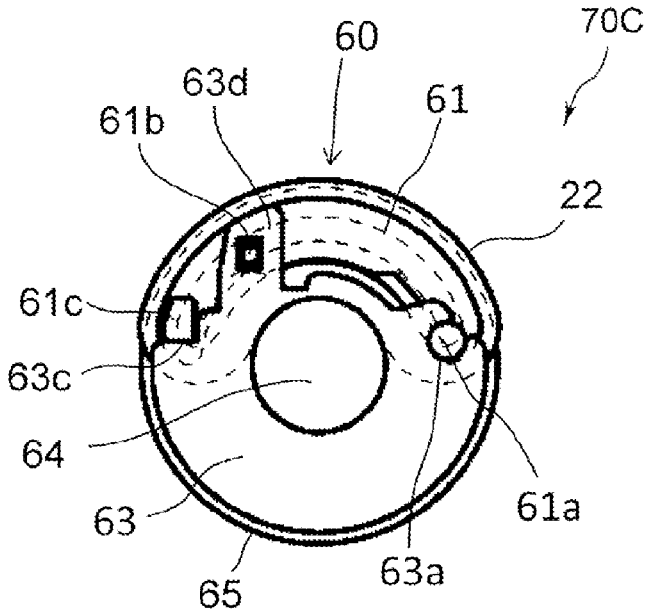
FIG. 9A is a cross-sectional view of a feeding roller when viewed in the direction of an arrow A-A illustrated in FIG. 2 according to a fourth embodiment.

FIG. 9A is a cross-sectional view of a feeding roller 70C when viewed in a direction of an arrow A-A illustrated in FIG. 2 according to the fourth embodiment. FIG. 9B is a partially enlarged cross-sectional view of FIG. 9A.

Figure 9B:
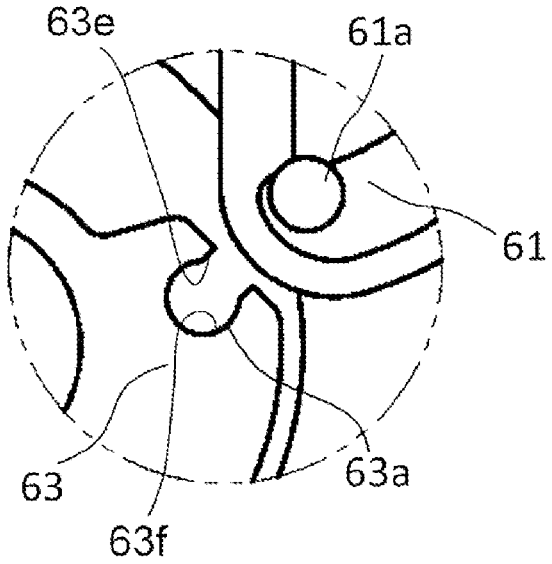
FIG. 9B is a partially enlarged cross-sectional view of FIG. 9A.
Figure 10A:
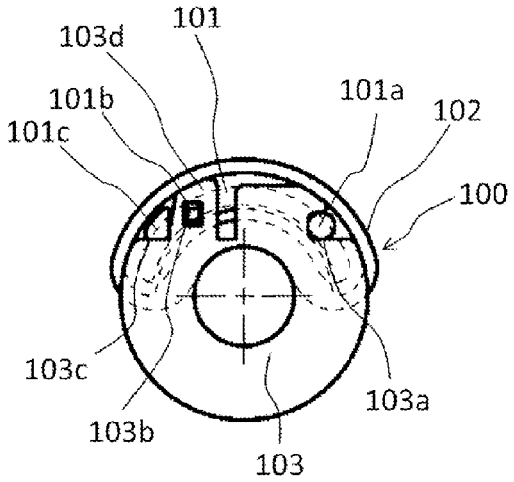
FIG. 10A PRIOR ART
FIG. 10A is a cross-sectional view illustrating a state in which a roller main body is attached to a roller holder according to an example of the related art.
Figure 10B:
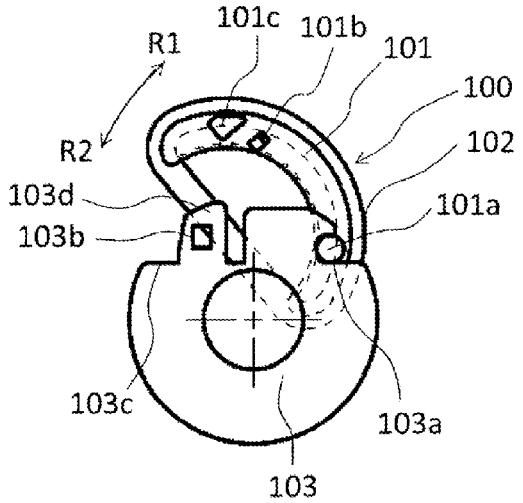
FIG. 10B PRIOR ART
FIG. 10B is a cross-sectional view illustrating a state in which a roller main body illustrated in FIG. 10A is being attached to a roller holder.
Figure 10C:
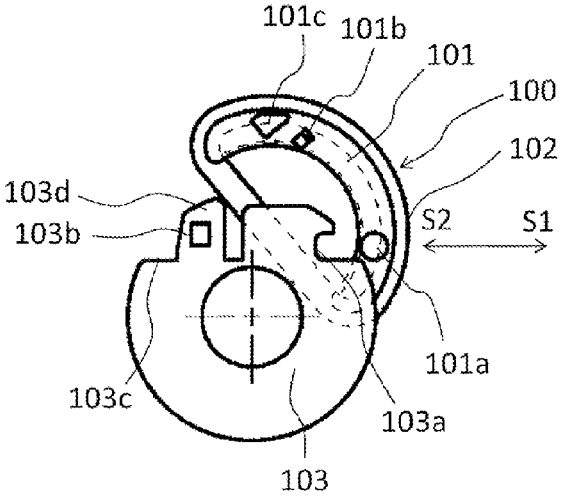
FIG. 10C PRIOR ART
FIG. 10C is a cross-sectional view illustrating a state in which a roller main body illustrated in FIG. 10A is to be attached to a roller holder.

As illustrated in FIGS. 9A and 9B, the feeding roller 70C includes a roller main body 60, roller holders 63 and 63, feeding rolls 65 and 65, and a feeding shaft 64. The roller main body 60 includes a roller core 61 and a rubber member 22, and the roller core 61 includes bosses 61*a* and 61*a*, ribs 61*b* and 61*b*, and ribs 61*c* and 61*c*. The bosses 61*a* and 61*a* are formed in a cylindrical shape.

The roller holders 63 and 63 include groove portions 63*a* and 63*a*, recesses 63*c* and 63*c*, and snap-fit portions 63*d* and 63*d*. The groove portions 63*a* and 63*a* include rotation sliding contact portions 63*f* and 63*f* that rotatably sliding the bosses 61*a* and 61*a*, and guiding path portions 63*e* and 63*e* that guide the bosses 61*a* and 61*a* to rotation sliding contact portions 63*f* and 63*f*. The rotation sliding contact portions 63*f* and 63*f* are formed in an arc shape, and formed to have a diameter substantially equal to a diameter of the bosses 61*a* and 61*a* so that the bosses 61*a* and 61*a* may be rotated. The guiding path portions 63*e* and 63*e* are formed to have a width smaller than the diameter of the bosses 61*a* and 61*a*, and formed to be elastically deformable so as to spread more than the diameter of the bosses 61*a* and 61*a*.

As described above, in the feeding roller 70C of the laser beam printer 1C according to the fourth embodiment, by forming the guiding path portions 63*e* and 63*e* to be elastically deformable, the bosses 61*a* and 61*a* may be mounted in rotation sliding contact portions 63*f* and 63*f* by press fitting. Thus, the bosses 61*a* and 61*a* may be easily mounted in the rotation sliding contact portions 63*f* and 63*f*. As a result, the roller main body 60 is prevented from deviating during an operation, and the roller main body 60 may be easily mounted on the roller holder 63 and 63. In other words, replacement of the roller main body 60 may be simplified.

Hereinabove, embodiments of the invention have been described. However, the invention is not limited to the above-described embodiments. Further, effects disclosed in the embodiments of the invention are merely given as most excellent effects obtained from the invention, and effects of the invention are not limited to the effects disclosed in the embodiments of the invention.

For example, the embodiments have been described using the laser beam printer 1 as an example of an electrophotographic image forming apparatus, and the invention is not limited thereto. A sheet feeding apparatus according to the invention may be used for an image forming apparatus employing an ink-jet method, a thermal transfer method, and the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-180629, filed Aug. 22, 2011, which is hereby incorporated by reference herein in its entirety.

What is claimed is:

1. A sheet feeding apparatus comprising a feeding roller that presses a sheet corresponding to an uppermost surface of sheets stacked on a sheet stacking portion and discharges the sheet, wherein the feeding roller includes a roller main body including a roller core having a segment of a circle as a cross-sectional surface orthogonal to an axial direction, and an elastic member wound around a roller surface of the roller core, and a roller holder, disposed on a feeding shaft, that supports the roller main body from both sides in the axial direction so that the elastic member of the roller main body protrudes to an outer circumstance, wherein the roller main body includes a shaft portion protruding from each of both side surfaces of an end portion of the roller core, and a locking portion formed on each of the both side surfaces of the roller core, the roller holder includes a supporting portion that detachably, attachably and rotatably supports the shaft portion, and a locked portion that fixes the roller main body to the roller holder by locking the locking portion of the roller main body that rotates using the shaft portion mounted on the supporting portion as a rotation fulcrum, the supporting portion includes a rotation sliding contact portion that rotatably slides the shaft portion, and a guiding path portion that guides the shaft portion to the rotation sliding contact portion, and the shaft portion includes a chamfered portion that is chamfered so that a length in a radial direction is smaller than a width of the guiding path portion, and the shaft portion is mountable on the rotation sliding contact portion through the guiding path portion by the chamfered portion.

2. The sheet feeding apparatus according to claim 1, wherein the guiding path portion is elastically deformed to be enabled to guide the shaft portion to the rotation sliding contact portion.

3. The sheet feeding apparatus according to claim 1, wherein the guiding path portion is formed so that a direction in which the shaft portion is guided to the rotation sliding contact portion is inclined by a predetermined angle with respect to a direction in which a reactive force is applied to the roller main body supported on the roller holder from the sheets.

4. An image forming apparatus comprising a feeding roller that presses a sheet corresponding to an uppermost surface of sheets stacked on a sheet stacking portion and discharges the sheet, and an image forming portion that forms an image on a sheet fed from the feeding roller, wherein the feeding roller includes a roller main body including a roller core having a segment of a circle as a cross-sectional surface orthogonal to an axial direction, and an elastic member wound around a roller surface of the roller core, and a roller holder, disposed on a feeding shaft, that supports the roller main body from both sides in the axial direction so that the elastic member of the roller main body protrudes to an outer circumstance, wherein the roller main body includes a shaft portion protruding from each of both side surfaces of an end portion of the roller core, and a locking portion formed on each of the both side surfaces of the roller core, the roller holder includes a supporting portion that detachably and rotatably supports the shaft portion, and a locked portion that fixes the roller main body to the roller holder by locking the locking portion of the roller main body that rotates using the shaft portion mounted on the supporting portion as a rotation fulcrum, the supporting portion includes a rotation sliding contact portion that rotatably slides the shaft portion, and a guiding path portion that guides the shaft portion to the rotation sliding contact portion, and the shaft portion includes a chamfered portion that is chamfered so that a length in a radial direction is smaller than a width of the guiding path portion, and the shaft portion is mountable on the rotation sliding contact portion through the guiding path portion by the chamfered portion.

5. The image forming apparatus according to claim 4, wherein the guiding path portion is elastically deformed to be enabled to guide the shaft portion to the rotation sliding contact portion.

6. The image forming apparatus according to claim 4, wherein the guiding path portion is formed so that a direction in which the shaft portion is guided to the rotation sliding contact portion is inclined by a predetermined angle with respect to a direction in which a reactive force is applied to the roller main body supported on the roller holder from the sheets.

* * * * *